United States Patent [19]

Kijewski

[11] 4,232,893

[45] Nov. 11, 1980

[54] DEVICE FOR GRIPPING TIRED WHEELS OF A VEHICLE

[75] Inventor: Joachim Kijewski, Bad Oeynhausen-Rehme, Fed. Rep. of Germany

[73] Assignee: Auto-Weber GmbH & Co. KG, Minden, Fed. Rep. of Germany

[21] Appl. No.: 926,969

[22] Filed: Jul. 21, 1978

[30] Foreign Application Priority Data

Jul. 23, 1977 [DE] Fed. Rep. of Germany ..... 2733406

[51] Int. Cl.[3] ..... B66C 1/20

[52] U.S. Cl. ..... 294/82 AH; 294/103 R

[58] Field of Search ..... 294/34, 67 R, 67 AB, 294/67 BB, 67 E, 78 R, 81 R, 82 AH, 86 R, 103 R, 103 CG, 74; 414/563

[56] References Cited

U.S. PATENT DOCUMENTS

| | | | |
|---|---|---|---|
| 1,677,695 | 7/1928 | Vogt | 294/82 AH X |
| 1,863,039 | 6/1932 | Chandler | 294/103 R X |
| 2,296,507 | 9/1942 | Donaldson | 294/82 AH |
| 2,325,235 | 7/1943 | Esbeck | 294/82 AH |
| 3,182,829 | 5/1965 | Wagner | 294/82 AH X |

FOREIGN PATENT DOCUMENTS

| | | | |
|---|---|---|---|
| 109996 | 8/1968 | Denmark | 294/103 R |
| 257713 | 3/1971 | U.S.S.R. | 294/82 AH |

*Primary Examiner*—Johnny D. Cherry
*Attorney, Agent, or Firm*—Emory L. Groff, Jr.

[57] ABSTRACT

A device for gripping tired wheels of a vehicle comprises, for each wheel, a pair of arms articulated at one end and provided with a suspension point, and a gripping device located at their other ends for engagement with the tire tread on each side of its ground engaging part, the gripping device including gripping limbs movable towards and away from each other for engaging or releasing the tire on opposite sides.

10 Claims, 5 Drawing Figures

DEVICE FOR GRIPPING TIRED WHEELS OF A VEHICLE

BACKGROUND OF THE INVENTION

The invention relates to a device for gripping the rubber tired wheels of a vehicle, e.g. a motor vehicle and for raising the vehicle. This device comprises individual supporting structures engaging the periphery of the tires of the wheels and having a suspension which becomes effective at a small distance above the axis of the wheel.

These devices serve either to load vehicles having rubber tires on the railway trucks or ships or to transport motor vehicles which have been incorrectly parked for example or which have broken down in a raised or loaded condition. In some cases in fact it is only necessary to raise the vehicle which is to be towed away only by the wheels of one axle instead of by all of the wheels. However, in the majority of different applications, it is just as important to protect the vehicle from damage.

Known devices of the type mentioned above use gripping devices having grips mounted on both sides on a support bracket for the purpose of gripping the wheels and these grips are pivoted with the aid of draw bolts underneath the axle of the wheel towards the latter and are pressed against the tread of the rubber tire. However, actuating these tractor screws has proved to be quite unwieldy and matching the gripping devices to the different vehicle wheels, which deviate from each other to a large extent both in diameter and in the width of the tires, involves considerable difficulties and complications.

SUMMARY OF THE INVENTION

It is an object of the invention to make available a device having a simpler construction and easier manipulation.

According to the invention, there is provided a device for gripping tired wheels of a vehicle comprising, for each wheel to be gripped, a pair of arms articulated together at one end, a suspension point provided at said articulated ends of said arms, a gripping device located at the other end of each of said arms for engagement with the treads of a tire on each side of their ground engagement portions and including a pair of gripping limbs movable towards and away from each other for engagement with opposite sides of the tire and disengagement therefrom.

BRIEF DESCRIPTION OF THE DRAWINGS

The invention will now be described in greater detail, by way of example, with reference to the drawings, in which.

DESCRIPTION OF THE PREFERRED EMBODIMENTS

Figure 1:
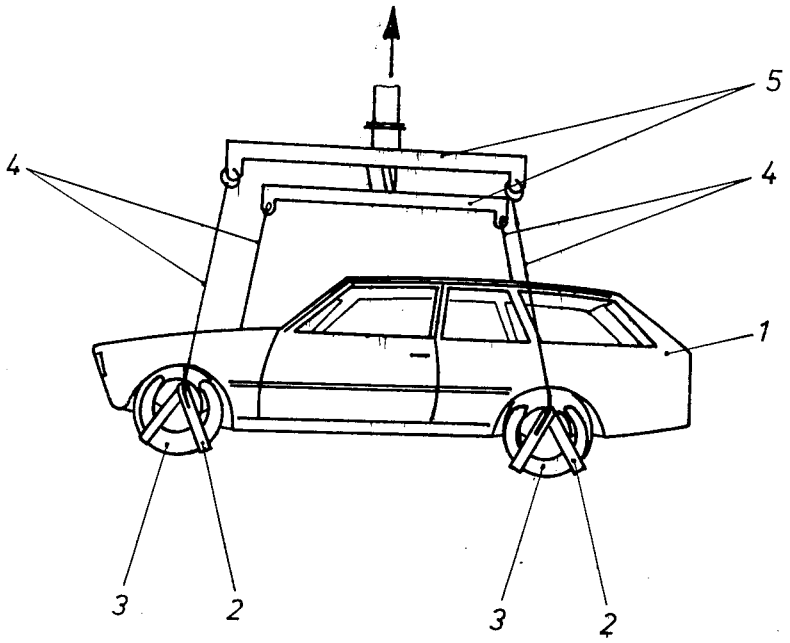
FIG. 1 shows the perspective view of a device in accordance with the invention when raising a motor vehicle equipped with wheels having rubber tires.
Figure 2:
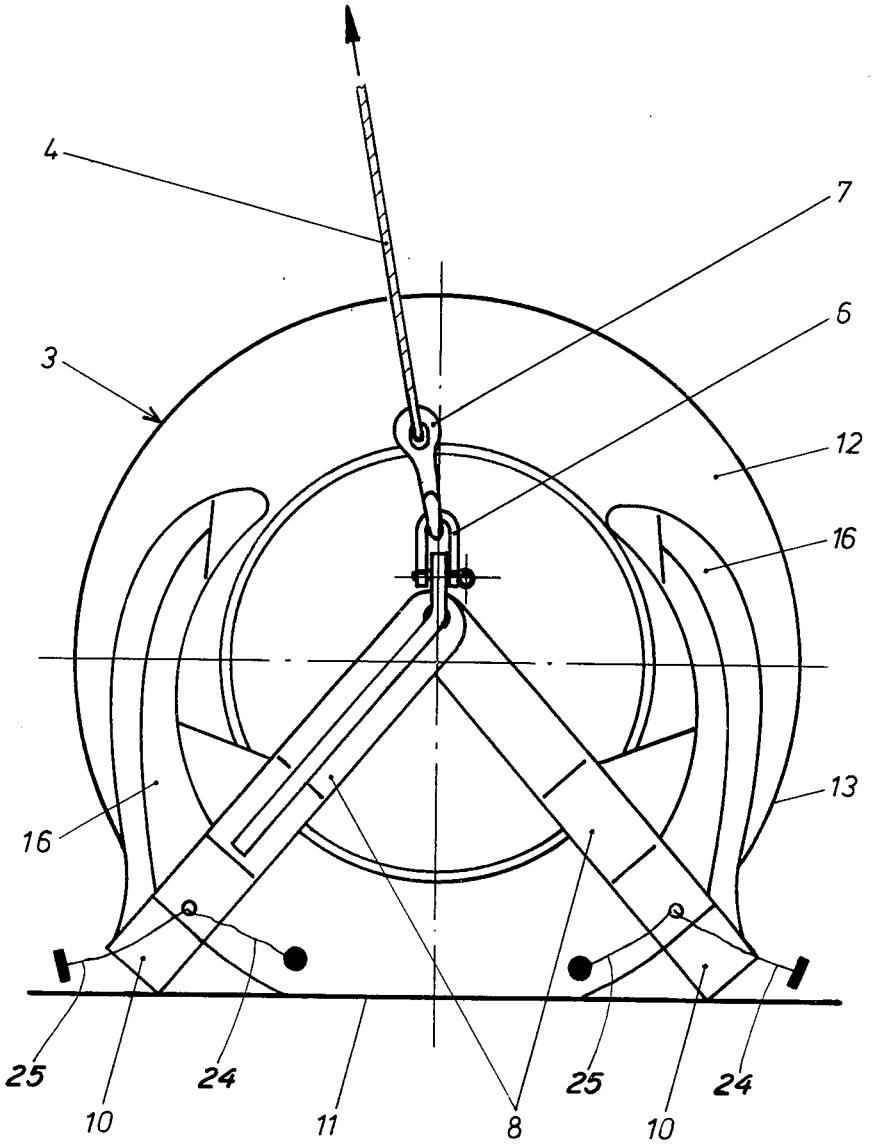
FIG. 2 shows the side view of a supporting structure of the device from FIG. 1 which serves to grip the vehicle wheels.

In a preferred embodiment of the invention the device proposes mainly that the supporting structures engaging the wheels equipped with rubber tires of the vehicle to be raised are formed in each case from two support arms which are connected together so as to be articulated in the plane of the wheel only in the region of their suspension, at the free end of which support arms, gripping devices which come into abutment against the tread on both sides of the surface on which the rubber tire stands are located, these gripping devices having two gripping members which can be displaced longitudinally with respect to each other parallel to the axle of the wheel and against the force of pressure storing elements and which press against the inside of the tires or the outside of the tires with gripping limbs and which are mounted in engagement with the rubber tire with the aid of an automatically acting locking device which is released manually.

A particularly advantageous refinement of the device claimed is provided if the gripping members of the gripping devices are substantially hollow cylinders, whereby the clamping members pressing against the inside of the tires with their clamping limbs are guided into the clamping members starting directly from the support arms and pressing against the outside of the tires with their gripping limbs and the pressure storing elements are arranged inside the two clamping members.

Furthermore it is recommended for the locking mechanism retaining the gripping members in engagement with the rubber tires to comprise a lock catch mounted on the inner clamping member, said catch being pressed against the inner surface of the outer hollow cylindrical clamping member for mutual locking of the clamping members under the influence of a spring and can be released from its locked position with the aid of a releasing cable. Furthermore it is advantageous to use spring-loaded gas storing devices as pressure storing elements for the gripping members of the gripping devices and to fix hand-operated tensioning cables to the gripping members pressing against the inside of the tires with their gripping limbs, with the aid of which tensioning cables they can be moved into their clamping position against the rubber tires.

For perfect functioning of the supporting structures gripping the vehicle wheels, it is important for the clamping limbs of the clamping members pressing against the outside of the tires to be dimensioned in length so that they terminate above the axle of the wheel when applied. Similarly the gripping limbs of the gripping members pressing against the outside of the tires should be curved outwardly in order to protect the wheel rims and possibly the hub caps at their edges facing the latter and the gripping limbs of the clamping members pressing against the inside of the tires should be provided with a crank for the purpose of enlarging their insertion length into the outer gripping members.

In relation to the state of the art described at the outset, the device developed by the invention has the advantage that the gripping members of its gripping devices can be applied to the rubber tires of the wheels very easily and rapidly without actuating any clamping bolts. Thus the supporting structures are continuously matched to the respective diameter of the wheel and to the width of the tires without there being the danger of damage to the wheel rims or hub caps. With as little effort, the gripping devices can be later released again from the wheels whereby, overall, a much smaller loading or transport time is to be achieved than when using conventional devices. Finally, the significantly smaller weight of the new type of device makes its use in practice much easier and its simpler construction permits exceptionally favourable manufacturing costs.

Referring now to the drawings, it will be seen from FIG. 1 the device described comprises several supporting structures 2 which are identical in construction for the purpose of raising a vehicle 1 equipped with rubber tires, these supporting structures 2 engaging the periphery of the tires of the wheels 3. From these supporting structures 2 crane cables 4 lead to the crossbars 5 of a vehicle crane which is not illustrated, with the aid of which the vehicle 1 can be raised as a whole and transported or loaded on to a transport vehicle. In another application of the supporting structure 2 it would be equally possible to raise the vehicle only by the front or rear wheels in order to be able to move it away in this condition on the crane hook of a towing or breakdown vehicle.

The supporting structures 2 shown in detail in FIGS. 2 to 5 are formed respectively from two support arms 8 which are connected together and articulated in the plane of the wheel only in the region of their suspension 6 for the hooks 7 of the crane cables 4. The support arms 8 are brought into a downwardly angled position, as can be seen from FIG. 2, for the purpose of applying to the vehicle wheels 3 the suspension 6 which becomes effective at a small spacing above the axle 9 of the wheel, and, in this position, gripping devices 10 located at the free ends of the support arms can come into abutment with the tread 13 on both sides of the surface 11 on which the rubber tire 12 stands. These gripping devices 10 of the support arms 8 have two clamping members 14 and 15 which are essentially hollow cylindrical particularly in accordance with FIGS. 3 and 4. Both of these clamping members 14 and 15 are equipped with clamping limbs 16 and 17 which press against the inside 18 of the tire or the outside 19 of the tire for the purpose of gripping the rubber tire 12.

Figure 4:
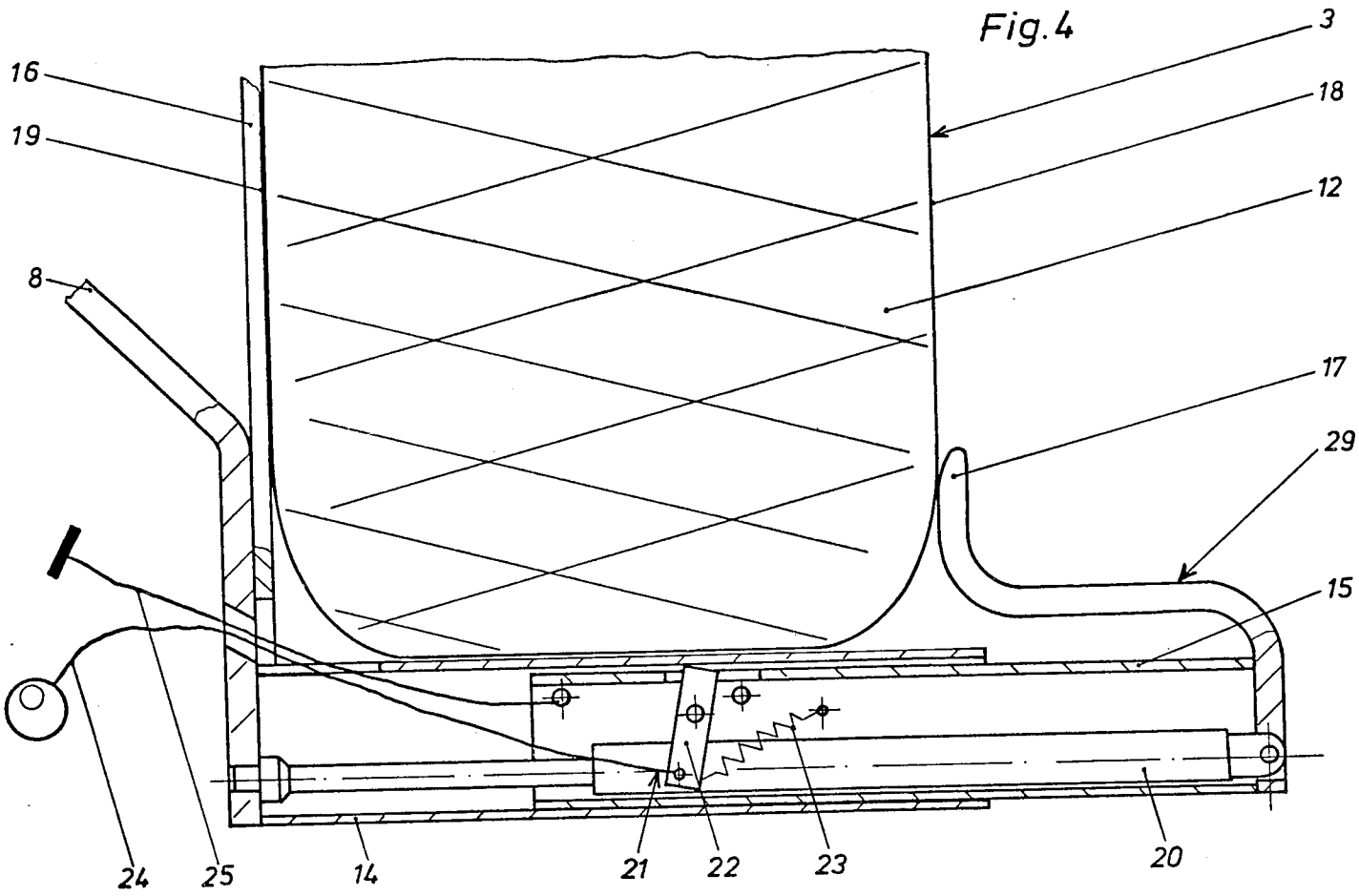
FIG. 4 shows the longitudinal section of one of the gripping devices of a supporting structure in accordance with FIGS. 2 and 3.
Figure 5:
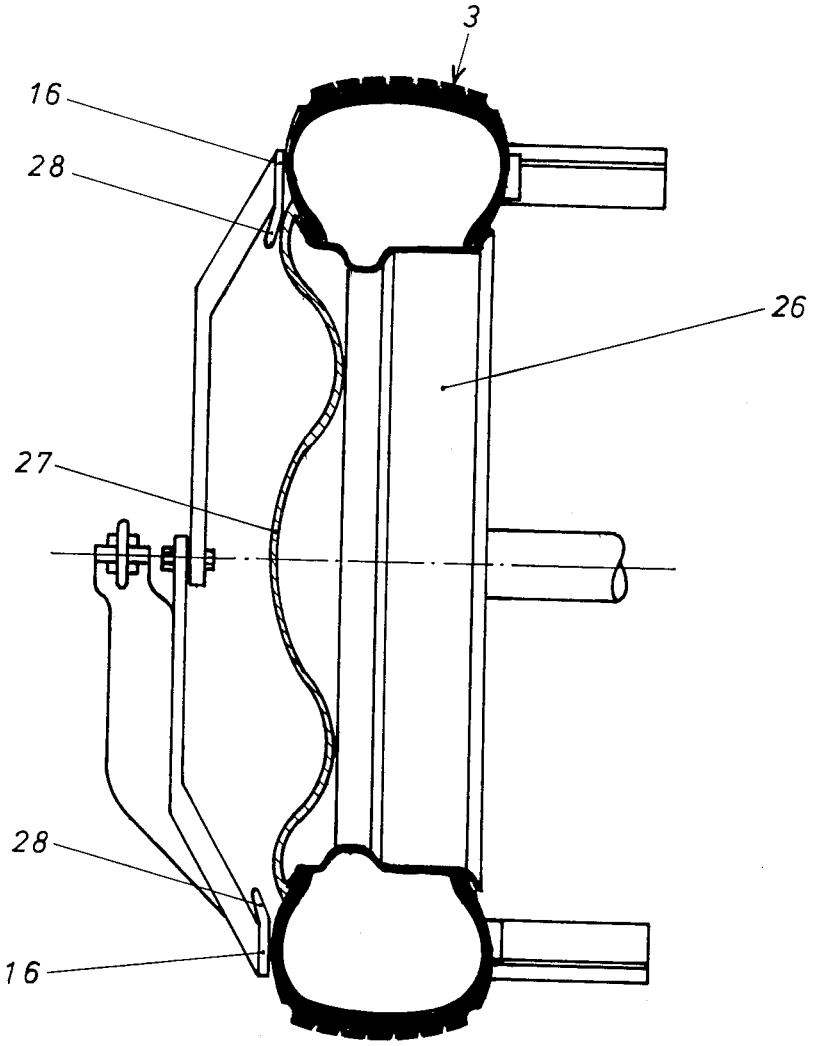
FIG. 5 shows the plan view of this supporting structure with a tire and hub cap of the wheel which is gripped thereby shown in cross-section.

As shown in FIG. 4, the clamping members 15 pressing against the inside 18 of the tire with their clamping limbs 17 are guided in the clamping members 14 pressing against the outside 19 of the tire with their clamping limbs 16 and starting directly from the support arms 8 in parallel to the axis 9 of the wheel against the force of a pressure storing element 20 so as to be longitudinally displaceable. The pressure storing element 20 constructed preferably as a spring-loaded gas storing device is arranged inside the two clamping members 14 and 15 as moreover is a locking device 21 which comprises a lock catch 22 mounted on the inner clamping member 15, a tension spring 23 engaging against it and a releasing cable 24. The lock catch 22 of this locking device 21 is pressed against the inner surface of the outer hollow cylindrical clamping member 14 under the influence of the spring 23 and this brings about locking of both clamping members 14 and 15 if the inner clamping member 15 has been moved into the outer clamping member 14 with the aid of a hand-operated tensioning cable 25 fixed to the clamping member 15 until the rubber tire 12 is firmly tensioned between the clamping limbs 16 and 17 of the two clamping members 14 and 15. In order to release the lock catch 22 later out of its clamping position, it is only necessary to actuate the release cable 24, whereupon the inner clamping member 15 is pushed out of the outer clamping member 14 automatically by the pressure storing element 20.

Figure 3:
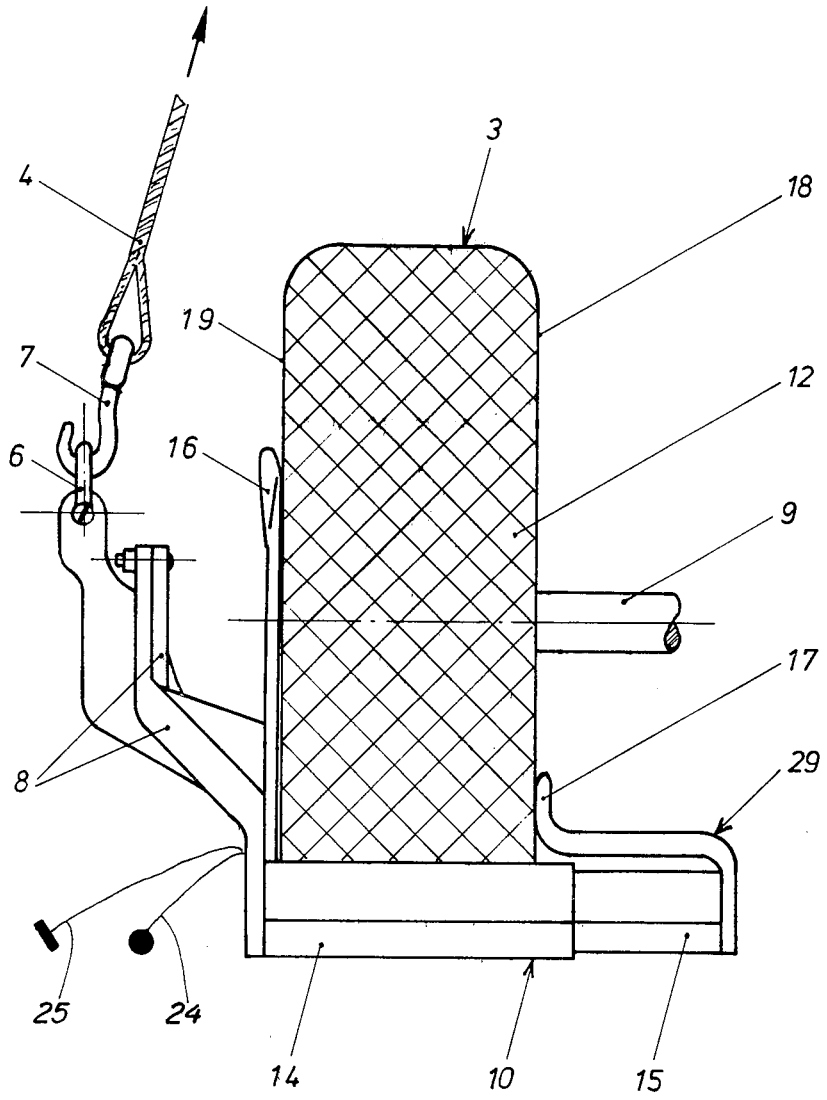
FIG. 3 shows the front view of the supporting structure shown in FIG. 2.

In accordance with FIG. 3 the suspension 6 of the supporting structures 2 is provided by cranking support arms 8 respectively far away from the vehicle wheels 3 so that damage to the vehicle coachwork by the crane cables 4 is avoided. Account is taken of the resultant tilting moment of the supporting structures 2 in terms of design inasmuch as the clamping limbs 16 of the outer clamping members 14, said clamping limb 16 pressing against the outside 19 of the tires, are dimensioned in length so that they terminate above the axle 9 of the wheel when the supporting structures 2 are in the applied condition. Furthermore these clamping limbs 16 are angled outwardly for the protection of the wheel rims 26 and hub caps 27 of the wheels 3 shown in FIG. 5 on the edges 28 directed towards the latter.

In order to enlarge their insertion length into the outer clamping members 14, the clamping limbs 17 of the clamping members 15 pressing against the inside 18 of the tires are provided with a bend 29 which can be seen from FIGS. 3 and 4. This measure also constitutes the precondition for the fact that the supporting structures 2 can be matched to any tire width which may arise. The necessity of also taking into account different wheel diameters is also fulfilled without difficulty since the supporting structures 2 can be matched continuously as desired because of the mobility of their support arms 8 to the wheels 3.

It will be understood that the above description of the present invention is susceptible to various modification changes and adaptations.

What is claimed is:

1. A device for gripping tired wheels of a vehicle comprising, for each wheel to be gripped, a pair of arms articulated together at one end, a suspension point provided at said articulated ends of said arms, a gripping device located at the other end of each of said arms for engagement with the tread of a tire on each axial side of their ground engagement portions, and each said gripping device including a pair of gripping limbs disposed respectively on opposite sides of the tire and movable towards and away from each other for gripping engagement with opposite sidewalls of the tire and disengagement therefrom.

2. A device for gripping tired wheels of a vehicle comprising, for each wheel to be gripped, a pair of arms articulated together at one end, a suspension point provided at said articulated ends of said arms, a gripping device located at the other end of each of said arms for engagement with the treads of a tire on each side of their ground engagement portions and including a pair of gripping limbs movable towards and away from each other for engagement with opposite sides of the tire and disengagement therefrom, a pressure storing element against the action of which the gripping limbs are moved towards each other and a manually releasable automatically acting locking device for retaining the gripping limbs in engagement with the tire.

3. A device as defined in claim 2, and comprising gripping members carrying said gripping limbs and displaceable longitudinally of each other parallel to the axle of the wheel.

4. A device as defined in claim 3, wherein said gripping members are substantially hollow cylinders, one inside the other with said pressure storing element situated inside the inner gripping member.

5. A device as defined in claim 4, wherein said locking device comprises a lock catch mounted in the inner gripping member and, being pressed against the inside of the outer gripping member for mutual locking of said gripping members under the influence of a spring and releasable from its locked position with the aid of a release cable.

6. A device as defined in claim 3, wherein said pressure storing element comprises a spring-loaded gas storing device.

7. A device as defined in claim 3, and comprising hand-operated tensioning cables fixed to the said gripping members for moving said gripping members into their gripping position on the rubber tires.

8. A device as defined in claim 3, wherein said gripping limbs of the outer gripping members are dimensioned in length so that they terminate above the axle of the wheel when applied thereto.

9. A device as defined in claim 3, wherein said gripping limbs pressing against the outside of the tires are angled off outwardly for protection of the wheel rims and possibly of the hub caps at their edges directed towards the latter.

10. A device as defined in claim 3, wherein the gripping limbs pressing against the inside of the tire are provided with a bend for enlarging their insertion length into the outer gripping members.

* * * * *